United States Patent [19]

Norlie et al.

[11] 4,268,175

[45] May 19, 1981

[54] TRACTOR MOUNTED SELF-LOADING CONCRETE MIXING APPARATUS

[76] Inventors: Robert N. Norlie, P.O. Box 824 Shelter Bay, La Conner, Wash. 98257; Bruce D. Norlie, Rte. 1, Box 348, Durham, Calif. 95938

[21] Appl. No.: 119,527

[22] Filed: Feb. 7, 1980

[51] Int. Cl.[3] ..... B28C 7/08

[52] U.S. Cl. ..... 366/19; 366/32; 366/39; 366/41; 366/62; 366/606

[58] Field of Search ..... 366/606, 19, 27, 30, 366/32, 39, 41, 44, 62, 63, 68

[56] References Cited

U.S. PATENT DOCUMENTS

| | | | |
|---|---|---|---|
| 1,253,945 | 1/1918 | Daniel | 366/606 X |
| 1,514,032 | 11/1924 | Blood | 366/41 |
| 1,685,529 | 9/1928 | Gilson | 366/26 |
| 2,327,473 | 8/1943 | Wagner et al. | 366/606 X |
| 2,520,033 | 8/1950 | Fuelling | 366/606 X |
| 2,664,276 | 12/1953 | Wagner et al. | 366/45 |
| 2,815,195 | 12/1957 | Bolt | 366/606 X |
| 3,246,884 | 4/1966 | Prichard et al. | 366/41 |
| 3,502,306 | 3/1970 | Beardsley | 366/41 X |
| 4,103,352 | 7/1978 | Cratty | 366/39 |

FOREIGN PATENT DOCUMENTS

| | | | |
|---|---|---|---|
| 313814 | 6/1929 | United Kingdom | 366/39 |
| 1371645 | 10/1974 | United Kingdom | 366/39 |

*Primary Examiner*—Philip R. Coe
*Attorney, Agent, or Firm*—Philip M. Shaw, Jr.

[57] ABSTRACT

Tractor mounted mixing apparatus is disclosed including a mounting frame attachable to a three-point tractor hitch, a mixing drum rotatably mounted to the frame and having mechanism for rotatably driving the drum, and a scoop pivotally connected to the support frame and power operated to move a scoop bucket from a lowered position for scooping material off the ground and a raised position adjacent an opening in the mixing drum for loading the drum.

7 Claims, 6 Drawing Figures

TRACTOR MOUNTED SELF-LOADING CONCRETE MIXING APPARATUS

BACKGROUND OF THE INVENTION

This invention relates to mixing apparatus, and more particularly to such mixing apparatus mounted to self-propelled vehicles, such as tractors.

Mixing apparatus, as for concrete, is well known and has long been in use. Various well known types of such apparatus have included those mounted to dollies which may be towed by a vehicle from place to place, and those large units which are mounted onto heavy duty truck chassis which may be driven from place to place. While the operation of all of these types of units is relatively conventional and straightforward, loading the mixing drums with the necessary portland cement, sand, gravel and water has generally required either substantial additional equipment or strenuous physical work by operators. In the case of the truck mounted apparatus, it has been common practice to build large loading hoppers and conveyors at a base site to which the truck can back up for loading. With the smaller equipment, it has generally necessitated either shoveling the materials into the mixing drum itself, or into a skip which may be lifted to a loading position, as illustrated in Gilson U.S. Pat. No. 1,685,529, Wagner et al. U.S. Pat. No. 2,327,473 or Beardsley U.S. Pat. No. 3,502,306. However, each of these skip loading structures has still required that the material be either shoveled into the scoop, or carried to it in wheelbarrows or other conveying means.

While there have been several types of tractor mounted equipment, such as Wagner et al. U.S. Pat. No. 2,664,276 and Bolt U.S. Pat. No. 2,815,195, most of the equipment has been for either stationary use, or has been of large scale for use on large trucks. This has created a need for convenient, self-propelled small units which may be utilized by a single person operating a vehicle such as a conventional farm tractor.

SUMMARY OF THE INVENTION

It is an object of the present invention to overcome the above-noted disadvantages of the prior art. More particularly, it is an object of this invention to provide tractor mounted mixing apparatus which is convenient for small scale use. It is another object of the invention to provide such mixing apparatus which may utilize the motive power of the tractor for achieving loading of the mixing drum. It is yet another object of the invention to provide such apparatus in which the loading means includes a bucket which may be used to scoop up material and which may then be used either to dump the material into the open end of a mixing drum, or to dump the material elsewhere for discharging.

To achieve these and other objects, which will become apparent to those skilled in the art, tractor mounted, self-loading mixing apparatus is disclosed which includes a mounting frame attachable to a standard three-point hitch mounting at the rear of a tractor, a mixing drum rotatably mounted to the frame with one end of the drum being open for receiving and discharging materials therethrough, a mechanism for rotatably driving the drum, and a scoop arrangement pivotally connected to the support frame. The scoop includes at least one support arm having one end pivotally connected to the frame for movement between a lowered position with the other end of the arm proximal the ground, and a raised position with the other end proximal the drum open end, and a mechanism for selectively moving the support arm between the lowered position and the raised position. The scoop further comprises a bucket arrangement including a bucket pivotally mounted to the arm adjacent the arm other end, with that bucket having an open first end for scooping material thereinto and a second end generally opposed to the first end and including selectively openable gate for selectively opening and closing off that second end, and the bucket being selectively pivotable between a first position with the first end facing generally downwardly and a second position with the second end facing generally downwardly. The bucket arrangement further includes apparatus for selectively pivoting the bucket between the first position and the second position and for holding the bucket at pivotal positions intermediate the first position and second position, whereby the bucket may be positioned intermediate the first and second positions with the open first end facing generally horizontally for scooping material such as gravel into the bucket when the support arm is in its lowered position, and then the arm may be raised and the bucket may be pivoted to either the first position for dumping the material out of the first end of the bucket, or the second position for dumping the material out the second end of the bucket.

BRIEF DESCRIPTION OF THE DRAWINGS

To illustrate this invention, a particularly preferred embodiment is disclosed in which.

DESCRIPTION OF THE PREFERRED EMBODIMENT

A particularly preferred embodiment of the mixing apparatus of this invention is illustrated in FIGS. 1 through 6. The apparatus is illustrated in detail in the foreground of FIG. 1 in a configuration for scooping material to be used for mixing concrete, and in the background of FIG. 1 as discharging mixed concrete.

Figure 1:
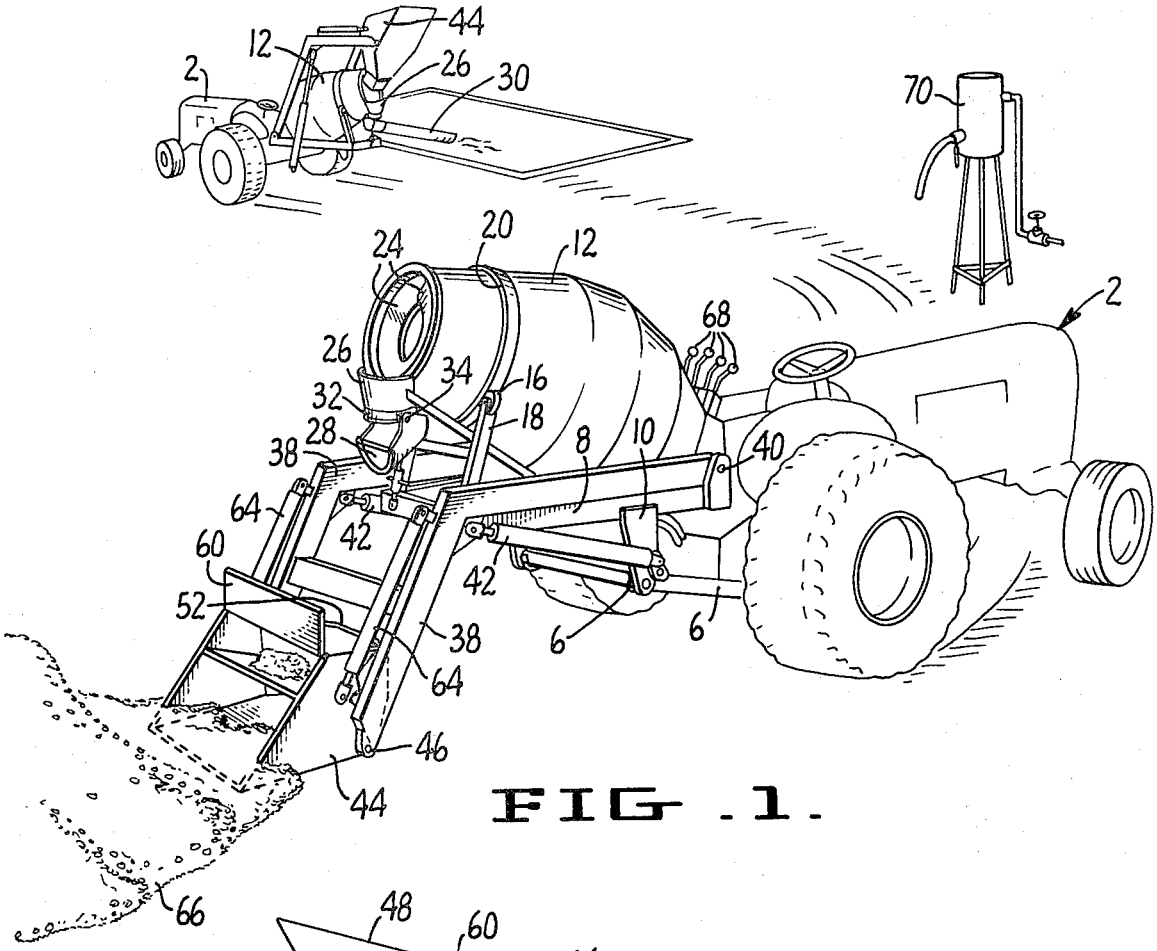
FIG. 1 is a perspective view of the mixing apparatus of this invention mounted to a tractor.

The apparatus of FIG. 1 includes a tractor 2, which may be any conventional farm tractor incorporating the standard three-point hitch with a fixed upper mount 4 (FIG. 2) and two hydraulically telescoping lower mounts 6 to raise and lower attached implements. Attached to the three-point hitch is support frame 8, having mounting posts 10 extending downwardly to the telescoping lower hitch supports 6.

Mixing drum 12 is rotatably mounted to support frame 8, suitably by a large front bearing assembly 14 and a pair of support rollers 16 mounted by arms 18 to frame 8 and bearing against a ring 20 affixed to the drum, although other convenient rotatable mountings may be used equally well. A suitable mechanism, such as hydraulic motor 22 is connected to the drum for rotatably driving the drum during mixing and discharge. Hydraulic power for this motor and all other hydraulic actuators is suitably provided by the hydraulic system of the tractor 2.

In a manner generally similar to that of truck mounted cement mixers, the drum is mounted with its axis of rotation inclined from horizontal, with the rear end projecting upwardly and being open for receiving and discharging materials therethrough. The opposite end suitably is closed. Within the drum are provided helical mixing and discharge baffles 24, so that rotation, as seen facing the drum from the rear, in a counterclockwise fashion will tend to urge materials toward the front end of the drum, thus holding the materials in and mixing them during such rotation. Correspondingly, rotation in the clockwise direction will cause the helical baffles to urge the material in the drum out the open rear end, when it is desired to discharge the materials. A hydraulic motor 22 provides for rotation in either direction under suitable control from control valves 68.

Immediately outside and below the lower portion of the rear end of drum 12 is the discharge baffle 26 which directs materials being discharged from the drum downwardly into the discharge chute stub 28 and chute extension 30, for directing to the proper location. The chute stub 28 suitably is pivotally mounted to ring 32 by pivot pins 34. A screwjack 36 supports the lower portion of stub chute 28 and provides for changing the angle of the shute 28 with respect to the ring 32, the ring 32 journalled onto a lip of the baffle 26 to provide for pivoting, and thus swinging the stub chute 28 and extension 30 from one side of the mixing apparatus to the other.

Also mounted to the mounting frame 8 is a scoop arrangement for loading the drum 12. This scoop arrangement includes at least one, and here preferably two support arms 38 having one end pivotally connected to the frame 8, suitably by pivot pins 40. Adjacent the crook in support arm 38 is pivotally connected an actuator, such as hydraulic cylinder 42, for selectively moving the support arm between a lowered position, illustrated in FIG. 1, and a raised position illustrated in the solid line representation of FIG. 2, in FIG. 3 and FIG. 5. This actuator 42 is also pivotally mounted to the support frame, suitably to the mounting posts 10.

Figure 2:
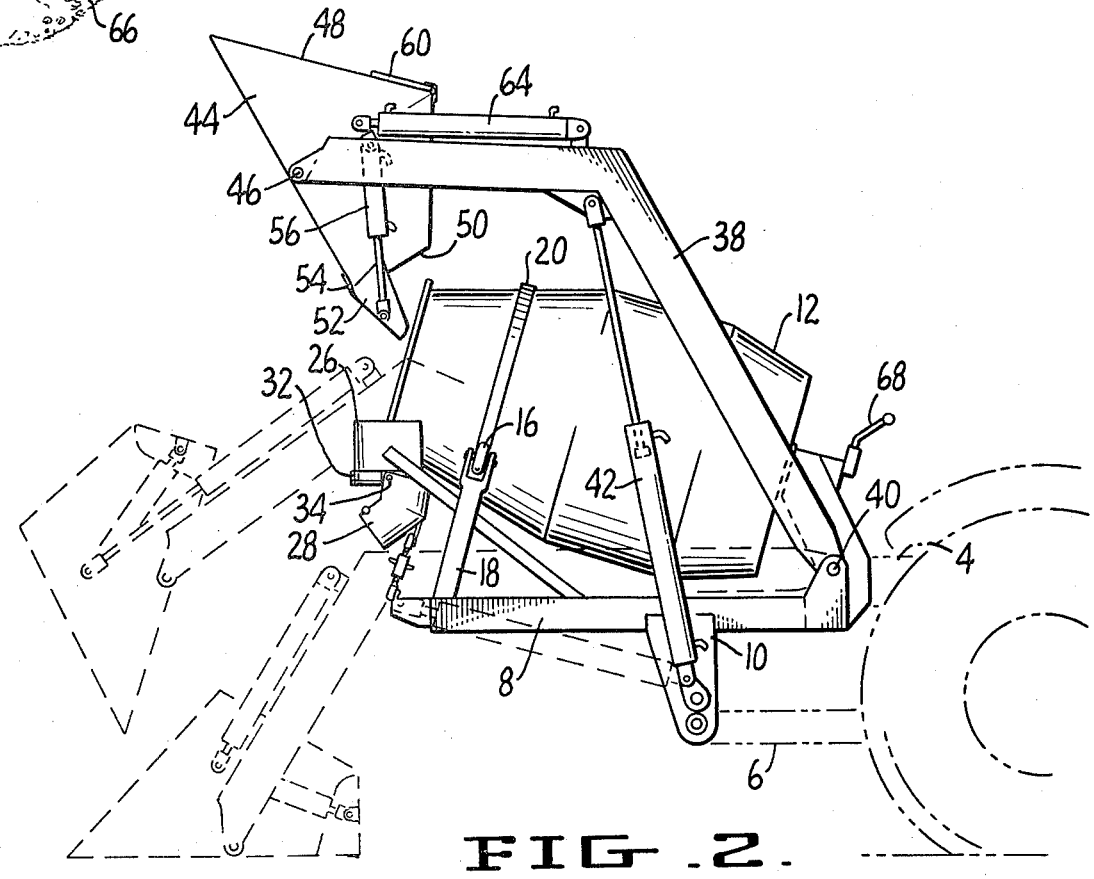
FIG. 2 is a side elevational view of the mixing apparatus of FIG. 1, showing the bucket and support arm in various positions.

At or adjacent the outer end of support arm 38, opposite the end pivotally connected to the support frame 8, is pivotally mounted a scooping bucket 44 which, like the rest of the apparatus, may suitably be fabricated of steel or other suitable material. The bucket 44 has an open first or outer end for scooping up material in a manner to be described below and has an inner or second end 50 which is also open. However, a trap door or gate 52 is pivotally mounted, as by hinge 54, to the bucket 44 at the second end 50 and is actuated by suitable means such as hydraulic cylinder 56 for selectively opening the second end 50, as shown in FIG. 2 or closing it off, as shown in FIGS. 1 and 4, for purposes to be described below.

Figure 3:
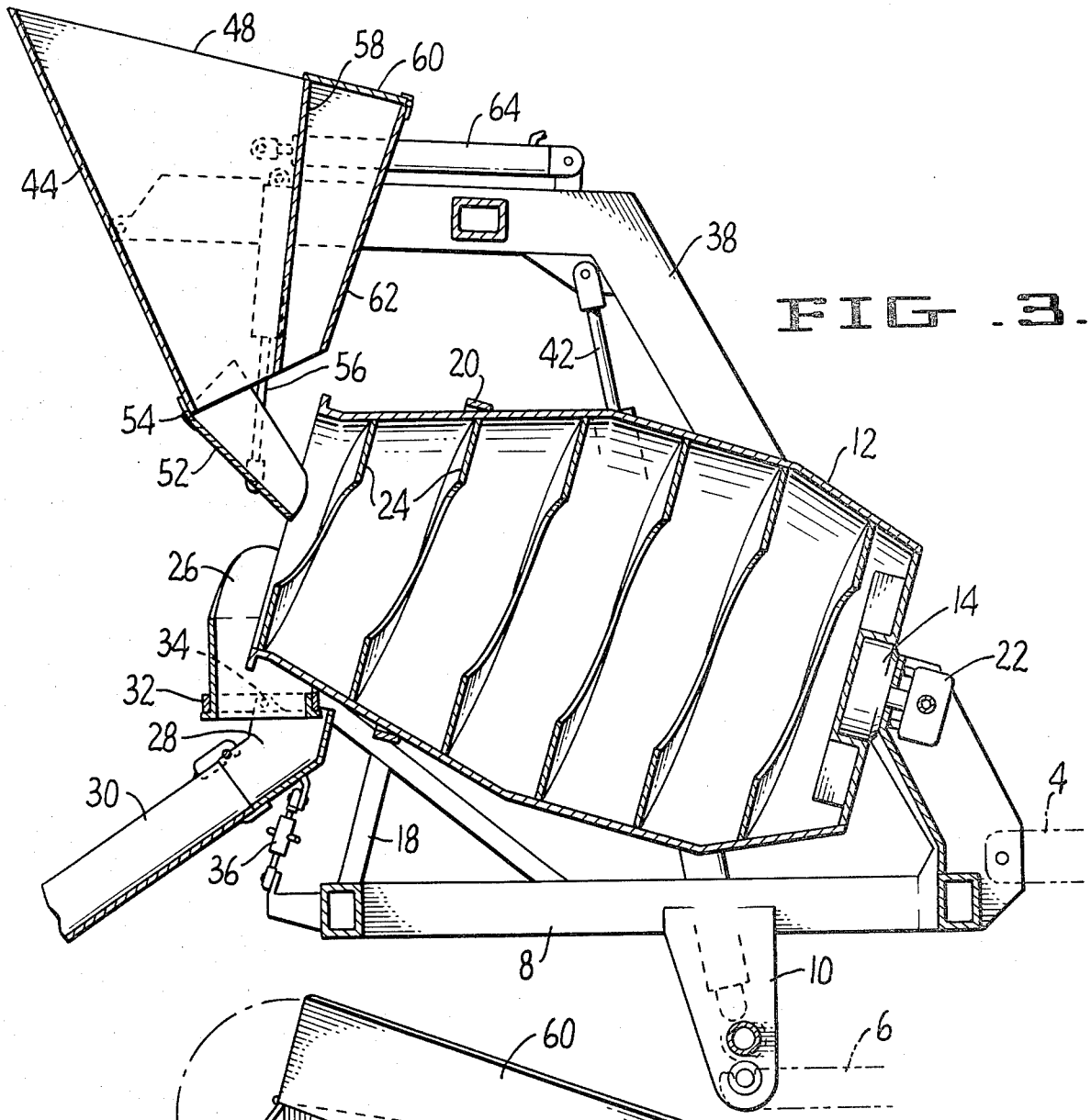
FIG. 3 is a side sectional view taken through the center of the apparatus of FIG. 2.
Figure 4:
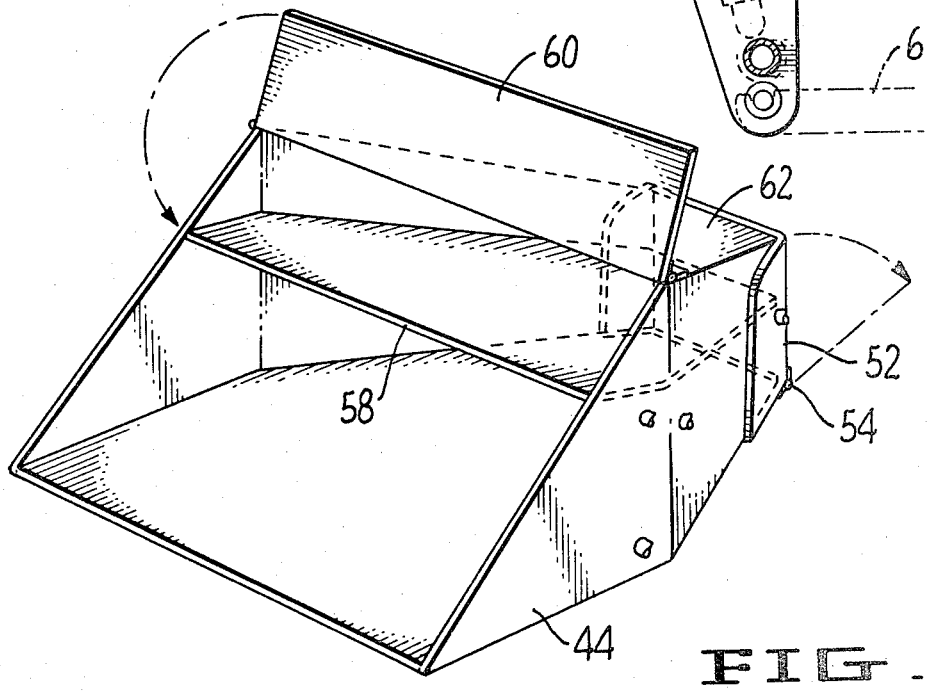
FIG. 4 is a perspective view of the bucket arrangement of the apparatus of FIG. 1.
Figure 5:
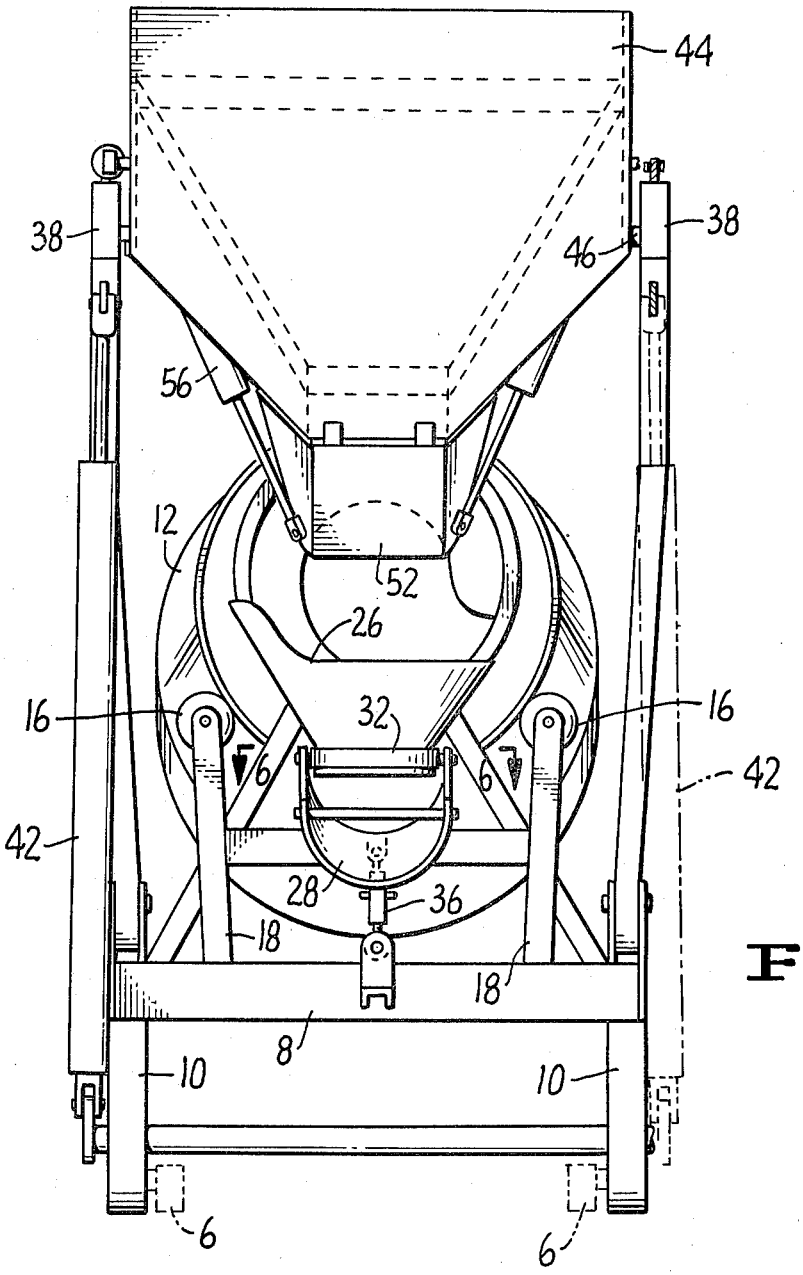
FIG. 5 is a rear elevational view of the apparatus of FIGS. 1 and 2.
Figure 6:
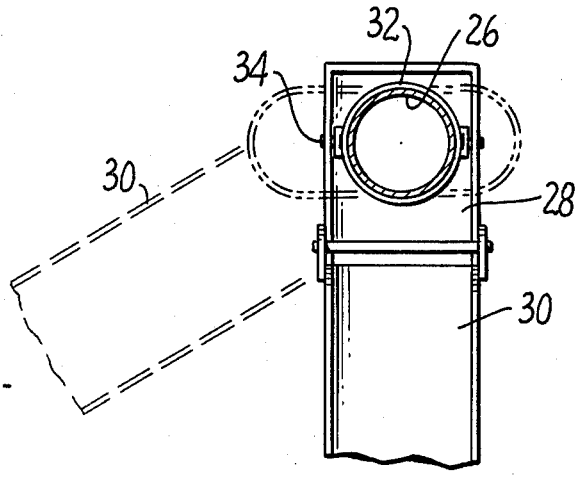
FIG. 6 is a sectional view taken along lines 6—6 of FIG. 5, illustrating the pivotal discharge shute.

As shown most clearly in FIGS. 1, 3 and 4, the scoop 44 includes within it a dividing panel 58 which divides the bucket into two sections, one above the other. Both the upper and lower sections communicate with the gate 52 and the open second end of the bucket. However, while the first end of the lower section of the bucket 44 remains open at all times, the upper section, above the dividing panel 58, includes a door 60 which is pivotally mounted to the top panel 62 enclosing the top of the bucket 44. This door is selectively openable and closable. In its open position the door 60 opens the upper section of the bucket 44 for entry from the front or first end of the bucket. In its closed position, shown in FIGS. 2 and 3, the door 60 closes off the outer or first end of the upper section of the bucket 44, and may preferably be held in place by a latch of conventional and well known construction, which is not shown.

The pivotally mounted bucket 44 is also connected to support arm 38 by one, or preferably a pair of actuators 64, which serve to control the pivoting of the bucket 44 about its pivot point 46.

For ease of mixing, in the manner to be described below, the bucket 44 in this preferred embodiment is dimensioned such that the upper section, above the dividing panel 58, will hold at least one cubic foot of dry portland cement. The lower section, below the dividing panel 58, is dimensioned to hold about six cubic feet of mixed sand and gravel, of the type commonly referred to as "concrete mix". Since the conventional mixing ratio of the mixed sand and gravel to dry portland cement is generally about six to one, this dimensioning provides for convenient measuring while loading, in the manner to be described below.

With the apparatus as described, its method of operation for mixing concrete may be seen from the illustrations. Before loading the cement and the sand and gravel aggregate into the drum, the drum is first charged with a predetermined quantity of water from water tank 70 illustrated in FIG. 1. As a convenience, the tank 70 may be provided with about fifteen gallons capacity and a float valve connected to an inlet line. This float valve is set to fill the tank only with the amount of water necessary for mixing one load of about six cubic feet of concrete. With such an arrangement the entire contents of the tank 70 may be emptied into the open outer end of the mixing drum 12 and then the tank closed off again and allowed to refill with another measured charge of water. Although the tank 70 is illustrated as spaced from the aggregate pile 66, it may most conveniently be placed alongside so that all of the loading operations may be conducted with minimal effort by the tractor operator.

After the water has been introduced into the drum 12, it is then loaded with the necessary cement and sand and gravel aggregate.

Unlike conventional apparatus which must be loaded by hand, or by shoveling material into a skip which is dumped into the drum, this apparatus provides for power operated self-loading. For example, with the bucket 44 oriented, by actuator 64, such that its base is substantially horizontal, the support arms 38 are lowered to place the bucket adjacent ground level next to a pile of the mixed sand and gravel. Then the door 60 covering the first end of the upper bucket section is opened and a bag, conventionally one cubic foot, of dry portland cement is dumped into that upper section. Then the door 60 is closed and latched and the tractor operator then backs the tractor and scoop bucket 44 into the pile 66 of the mixed sand and gravel, thus scooping into the lower bucket section a full load of about six cubic feet. The bucket may then be raised, by raising support arms 38 by means of actuators 42, to the position illustrated in FIGS. 3 and 5 and in the solid line representation of FIG. 2. The bucket 44 may then be pivoted to the position illustrated in FIGS. 2, 3 and 5, with the second end 50 facing generally downwardly and adjacent the open rear end of drum 12. In this position the outer ends of arms 38 are also generally proximal the open outer end of the drum 12, as illustrated in FIGS. 2 and 3. With the bucket in this position and orientation, the gate 52 may be opened by actuating cylinders 56, as by control 68, to lower the gate 52 to the position illustrated in FIGS. 2, 3 and 5, thus dumping the entire contents of the bucket, both the dry portland cement and the mixed sand and gravel, into the interior of the mixing drum 12, which suitably is rotating in the counterclockwise manner. This single operation thus charges the drum with the one cubic foot of cement and six cubic feet of sand and gravel necessary for making six cubic feet of concrete. To free any trapped aggregate, the bucket pivoting actuator 64 may be operated back and forth to shake the bucket 44.

From this loading and dumping operation can be seen the benefit of the divided bucket 44. Since the mixed sand and gravel is frequently damp, and since dry portland cement tends to cake in the presence of any moisture, by providing the divided bucket and the door 60 over the first end of the upper section, this moist gravel can be kept out of contact with the dry cement at all times during the scooping operation and until it is dumped.

As illustrated in the intermediate phantom line representation in FIG. 2, the bucket 44 may not only be pivoted to orient the second end 50 facing generally downwardly for dumping into the mixing drum 12, but it may also be pivoted, by means of actuator 64, in the opposite direction to place the first end 48 in a generally downward facing orientation, in the event that it is desired to dump material within the bucket back out of the bucket instead of loading it into the drum. This feature also enables the scoop assembly to function in the manner similar to that of a power shovel, such as for loading materials into the bed of a truck.

With the necessary water, cement and sand and gravel aggregate introduced into the drum, the mixing may be performed by rotation of the drum in the counterclockwise manner, by the hydraulic motor 22. This rotating mixing may be initiated while the materials are being introduced into the drum, or shortly thereafter, if desired. The mixing may then continue as the tractor 2 is driven from its loading site to the pouring site, as illustrated in the upper left portion of FIG. 1. Frequently the only mixing necessary will be that which occurs during transit time from the loading site to the pouring site, so that no time is lost in mixing. At this point the dumping chute extension 30 is hooked onto the chute stub 28 and the two of them pivoted to one side or the other of the tractor as desired to direct the concrete to the point desired. The chutes are pivoted vertically under the control of the screwjack 36 to raise or lower the outer end of the chute as desired. With the chute in place, the direction of rotation of the mixing drum 12 is then reversed, to a clockwise direction, so that the helical baffles 24 will then urge the concrete outwardly of the drum, down the dumping baffle 26 and out the chutes 28 and 30.

While the preferred embodiment has been described in the context of apparatus for mixing concrete, it should be obvious that the apparatus of this invention is equally suitable for mixing numerous materials other than concrete, including grain and animal feed, to name but a few. Further, while the preferred embodiment has been described with the inclusion of the scoop bucket 44 of a predetermined size and having two separate compartments, obviously the bucket could be of any desired size with a single compartment or more than two, as desired, all within the scope of the invention. The size disclosed is of particular convenience since it serves a premeasuring function. Clearly other actuating and drive mechanisms could also be interchanged with those illustrated, all without the parting from the scope of the present invention. Thus, since these and numerous other uses, modifications and variations of this structure, all within the scope of the invention, will readily occur to those skilled in the art, this invention is to be limited not by the disclosed embodiment, but solely by the claims appended thereto.

What is claimed is:

1. Tractor-mounted, self-loading mixing apparatus, comprising a mounting frame attachable to a standard three-point hitch mounting at the rear of a tractor for support from the tractor;

a mixing drum rotatably mounted to said frame with the axis of rotation inclined from horizontal with the end of said drum which projects upwardly being open for receiving and discharging material therethrough;

means for rotatably driving said drum; and scoop means pivotally connected to said support frame and including at least one support arm having one end pivotally connected to said frame for movement between a lowered position with the other end of said arm proximal the ground and a raised position with said other end proximal said drum open end;

means for selectively moving said support arm between said lowered position and said raised position;

bucket means including a bucket pivotally mounted to said arm adjacent said other end thereof, said bucket having an open first end for scooping material thereinto and a second end generally opposed to said first end and including selectively openable gate means for selectively opening and closing off said second end, and said bucket being selectively pivotable between a first position with said first end facing generally downwardly and a second position with said second end facing generally downwardly, and means for selectively pivoting said bucket between said first position and said second position and for holding said bucket at pivotal positions intermediate said first position and said second position, whereby the bucket may be positioned intermediate the first and second positions with the open first end facing generally horizontally for scooping material such as gravel into the bucket when the support arm is in its lowered position, and then the arm may be raised and the bucket may be pivoted to either the first position for dumping the material out the first end of the bucket, or the second position for dumping the material out the second end of the bucket.

2. The apparatus of claim 1 wherein said bucket pivoting means includes means for shaking said bucket means when said bucket means is in said first position or said second position.

3. The apparatus of claim 1 wherein said bucket is dimensioned to hold at least six cubic feet of material.

4. The apparatus of claim 1 wherein said bucket means includes means dividing the bucket into at least two sections with each said section communicating with said gate means, whereby cement may be placed into one of the sections and mixed gravel and sand into another, with both cement and the mixed gravel and sand being dumped out the gate means when the gate means is opened with the second end of the bucket facing downwardly.

5. The apparatus of claim 4 wherein one said bucket section is spaced vertically from another said section, whereby dry portland cement may be placed into the upper section and mixed sand and gravel into the lower section without moisture present in the sand and gravel being introduced into the section holding the cement.

6. The apparatus of claim 5 wherein the lower said bucket section is dimensioned to hold about six cubic feet of mixed sand and gravel and the upper section is dimensioned to hold at least one cubic foot of dry portland cement, whereby such amounts of cement and the sand and gravel mix may be placed in the bucket for simultaneous dumping into the mixing drum to provide for mixing of concrete having that predetermined ratio of such components.

7. The apparatus of claim 5 wherein said bucket means includes selectively openable and closable door means covering a portion of the upper said bucket section, whereby the door may be closed for introducing cement into the upper section, and then closed to exclude gravel scooped into the lower section from spilling into the upper section.

* * * * *